US008778468B2

(12) United States Patent
Shaarawi et al.

(10) Patent No.: US 8,778,468 B2
(45) **Date of Patent: *Jul. 15, 2014**

(54) METALIZED PRINTABLE RECORDING MEDIUM

(75) Inventors: Mohammed S. Shaarawi, Corvallis, OR (US); Vladek Kasperchik, Corvallis, OR (US); Tienteh Chen, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/820,005

(22) PCT Filed: Oct. 22, 2010

(86) PCT No.: PCT/US2010/053704

§ 371 (c)(1),
(2), (4) Date: Feb. 28, 2013

(87) PCT Pub. No.: WO2012/054054

PCT Pub. Date: Apr. 26, 2012

(65) Prior Publication Data

US 2013/0162740 A1 Jun. 27, 2013

(51) Int. Cl.

| | |
|---|---|
| ***B41M 5/00*** | (2006.01) |
| ***B41M 5/06*** | (2006.01) |
| ***B41M 5/50*** | (2006.01) |
| ***B05D 5/06*** | (2006.01) |

(52) U.S. Cl.

CPC ..... *B41M 5/50* (2013.01); *B41M 5/506* (2013.01); *B05D 5/067* (2013.01); *B41M 2205/40* (2013.01)

USPC ..... 428/32.34; 428/32.25; 428/32.32; 427/152; 347/106

(58) Field of Classification Search

CPC .... B41M 3/008; B41M 5/0023; B41M 5/502; B41M 5/506; B41M 5/508; B41M 11/322; B41M 5/50; B41M 2205/40; B05D 5/066–5/068; B42D 15/00; C09D 11/037; C09D 11/322; B41J 2/215

USPC ..... 106/31.65, 31.9; 347/105, 106; 428/32.25, 32.32, 32.34; 427/152

See application file for complete search history.

(56) References Cited

U.S. PATENT DOCUMENTS

| | | | |
|---|---|---|---|
| 4,358,779 | A | 11/1982 | Hohn et al. |
| 6,649,250 | B2 | 11/2003 | Laney et al. |
| 7,435,448 | B2 | 10/2008 | Looman et al. |
| 7,704,574 | B2 | 4/2010 | Burch et al. |
| 2003/0186020 | A1 | 10/2003 | Kasahara |
| 2009/0123674 | A1 | 5/2009 | Shaw-Klein et al. |

FOREIGN PATENT DOCUMENTS

| | | | |
|---|---|---|---|
| EP | 1228889 | A2 | 8/2002 |
| JP | 2000-043402 | | 2/2000 |
| JP | 2005-280093 | | 10/2005 |
| WO | WO 2009/091361 | A1 | 7/2009 |

OTHER PUBLICATIONS

International Search Report and Written Opinion for PCT/US2010/053704 dated Jun. 27, 2011 (9 pages).

*Primary Examiner* — Bruce H Hess
(74) *Attorney, Agent, or Firm* — Sandra Beccarelli

(57) ABSTRACT

A metalized printable recording medium including a porous metallic reflective top layer, a porous ink-absorbing layer and a bottom supporting substrate. Method to form such printable recording medium and method to form printed images on the metalized printable recording medium are also disclosed.

15 Claims, 3 Drawing Sheets

METALIZED PRINTABLE RECORDING MEDIUM

BACKGROUND

Inkjet recording is a non-impact method that, in response to a digital signal, produces droplets of ink that are deposited on a substrate, i.e. a printable recording medium or media. There are several classes of inkjet printer, for instance piezoelectric and thermal drop-on-demand printers and continuous inkjet printers. The inkjet process is now a widely used printing process since it can be carried out using relatively cheap and reliable printers without noise and with high quality and has found broad application as output for personal computers in the office and the home.

With increasing improvement in the availability and mode of operation of inkjet printers, there is great interest in using the inkjet process in many imaging and display applications. Consequently, increasingly severe requirements are being set for the recording materials and for the prints produced. Such recording is thus supposed to have, for example, high resolution, high color density, sufficient ink gradation and good light fastness. In addition, there is an increasing interest in providing prints with a glossy image surface, or with more particular features such as highly reflective metallic appearance and/or electrical conductivity for new applications such as decorative, label and security or anti-counterfeiting printing.

Consequently, it has become common to provide recording materials comprising a supporting substrate, such as plain paper for example and at least one ink-receptive recording layer arranged thereon, the recording layer imparting the specific desired features to the media.

However, though the above list of characteristics provides a worthy goal to achieve, there are difficulties associated with satisfying all of the above characteristics.

BRIEF DESCRIPTION OF THE DRAWING

The drawings illustrate various embodiments of the present system and method and are part of the specification.

DETAILED DESCRIPTION

Figure 1:
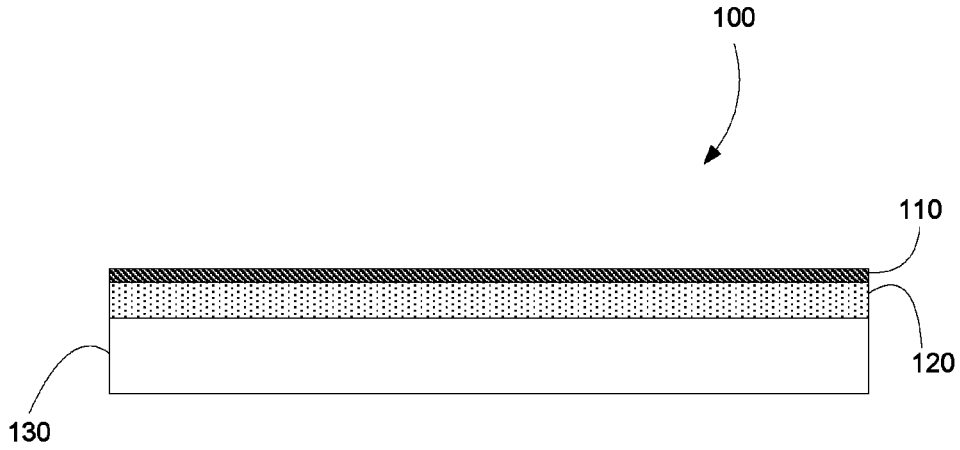
FIG. 1 is a cross-sectional view of a recording material, including coating layers that are applied to one side of the supporting substrate, according to some embodiments of the present disclosure.

Before particular embodiments are disclosed and described, it is to be understood that the present disclosure is not limited to the particular process and materials disclosed herein. It is also to be understood that the terminology used herein is used for describing particular embodiments only and is not intended to be limiting, as the scope of the present invention will be defined only by the claims and equivalents thereof. In describing and claiming the present recording medium and method, the following terminology will be used: the singular forms "a", "an" and "the" include plural referents unless the context clearly dictates otherwise. Thus, for example, reference to "a pigment" includes reference to one or more of such materials. Concentrations, amounts and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For example, a weight range of approximately 1 wt % to about 20 wt % should be interpreted to include not only the explicitly recited concentration limits of 1 wt % to about 20 wt %, but also to include individual concentrations such as 2 wt %, 3 wt %, 4 wt % and sub-ranges such as 5 wt % to 15 wt %, 10 wt % to 20 wt %, etc. Wt % means herein percentage by weight. All percents are by weight unless otherwise indicated.

As used herein, "plurality" refers to more than one. For example, a plurality of polymers refers to at least two polymers. As used herein, the term "about" is used to provide flexibility to a numerical range endpoint by providing that a given value may be "a little above" or "a little below" the endpoint. The degree of flexibility of this term can be dictated by the particular variable and would be within the knowledge of those skilled in the art to determine based on experience and the associated description herein.

As used herein, "image" refers to marks, signs, symbols, figures, indications and/or appearances deposited upon a material or substrate with either visible or an invisible ink composition. Examples of an image can include characters, words, numbers, alphanumeric symbols, punctuation, text, lines, underlines, highlights and the like. As used herein, "inkjet image" refers to image that is generated by the use of inkjet device and/or inkjet ink.

The present disclosure provides printable recording material. In some examples, such printable recording or receptive material is a metalized printable recording medium. In some other examples, printable recording material is an inkjet recording material well adapted for inkjet printing device. The recording material can be defined as a multilayered structure that includes a porous metallic reflective top layer, a porous ink-absorbing layer and a bottom supporting substrate. In other words, the recording material is a multilayered structure that encompasses a bottom supporting substrate and coating layers. The recording material is a multilayered structure that can further include a glossy porous protective layer located below the reflective top layer.

The term "ink-receiving layer" refers to a layer, or multiple coating layers, that are applied to a supporting substrate and which are configured to receive ink upon printing. As such, the ink-receiving layers do not necessarily have to be the outermost layer, but can be a layer that is beneath other coating. Ink-receiving layers might be in the form of a porous media coating.

The bottom supporting substrate can be a photobase. As used herein, the term "photobase" refers to a base paper, e.g., raw base paper, which is coated on at least one side with a moisture barrier layer. In some examples, the "photobase" is coated on both sides with a moisture barrier layer.

In some examples, the printable recording medium of the present disclosure is a metalized porous substrate that can be used for inkjet printing and that combines high metallic reflectivity with an enhanced print edge definition and high liquid absorbing capacity. The printable recording medium has thus a metallic appearance, has an electric conductivity and an optical reflectivity of a metal foil. The surface of the media described herein, while having both reflectivity and conductivity features, is highly porous and has excellent liquid-absorbing capacity. The printable medium is, thus, an inkjet printing media that combines an electrically conductive surface while maintaining overall media porosity. The medium can therefore be used in inkjet printing technique, while having good printing quality and high edge definition inherent to high-end inkjet photo papers. Indeed, the printable medium has the benefit of having very fast absorption of ink liquid phase that result in fast drying of the inks deposited onto said media. Such fast ink absorption result therefore in good print resolution, quality and edge definition.

In addition, the printable recording medium is a metallic reflective media surface. The metalized media is perceived as optically smooth and capable of strong metallic specular reflection with specular reflectivity at 20° that is equal or superior to 10%.

In some embodiments, the metalized printable recording medium according to the present disclosure is a multilayered structure including a porous metallic reflective top layer, a porous ink-absorbing layer and bottom supporting substrate. In some other embodiments, the metalized printable recording medium is a multilayered structure including a porous metallic reflective top layer, a glossy porous layer, a porous ink-absorbing layer and bottom supporting substrate. Such combination of layers and supporting substrate forms a metalized printable recording medium having improved printing characteristics and conductive and reflective features.

Figure 2:
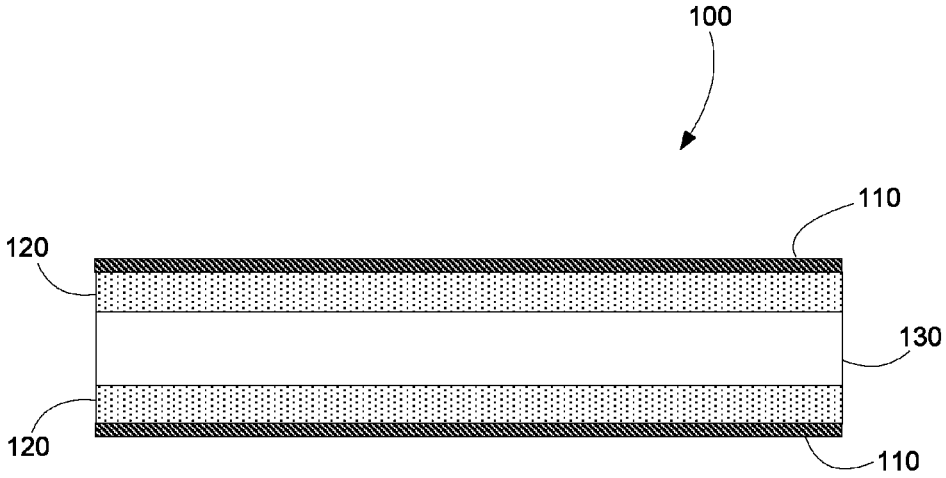
FIG. 2 is a cross-sectional view of a recording material, including coating layers that are applied to both sides of the supporting substrate, according to some embodiments of the present disclosure.

In some examples, such as illustrated in FIGS. 1 and 2, the printable recording material (100) contains a supporting substrate (130), a porous ink-absorbing layer (120) applied to at least one surface of said substrate (130) and a porous metallic reflective top layer (110) applied over the porous ink-absorbing layer (120). The reflective top layer (110) is a porous metallic reflective top layer on which the ink is deposited to form the printed feature.

In some examples, such as illustrated in FIG. 1, the porous metallic reflective top layer (110) and the porous ink-absorbing layer (120) are applied to only one side of the supporting substrate (130). If the coated side is used as an image-receiving side, the other side, i.e. backside, may not have any coating at all, or may be coated with other chemicals (e.g. sizing agents) or coatings to meet certain features such as to balance the curl of the final product or to improve sheet feeding in printer. In some other examples, such as illustrated in FIG. 2, the porous metallic reflective top layer (110) and the porous ink-absorbing layer (120) are applied to both opposing sides of the supporting substrate (130). The double-side coated medium has a sandwich structure, i.e., both sides of the supporting substrate (130) are coated with the same coating and both sides may be printed with images or text.

Figure 3:
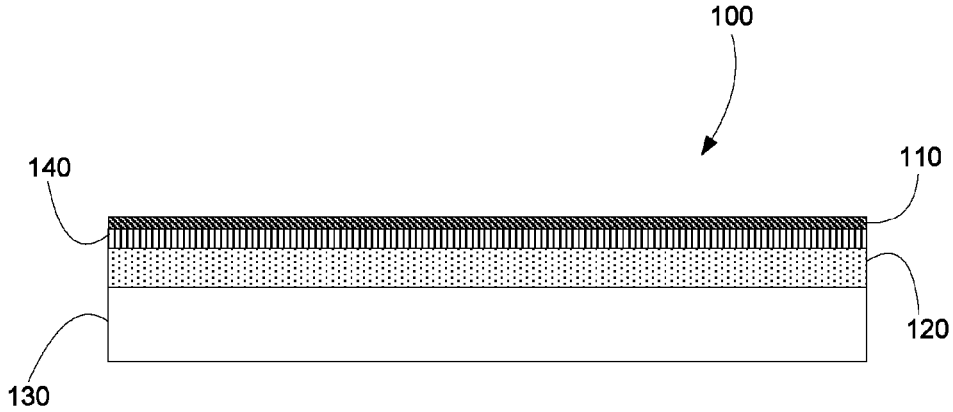
FIG. 3 is a cross-sectional view of a recording material, including coating layers that are applied to one side of the supporting substrate, according to some other embodiments of the present disclosure.
Figure 4:
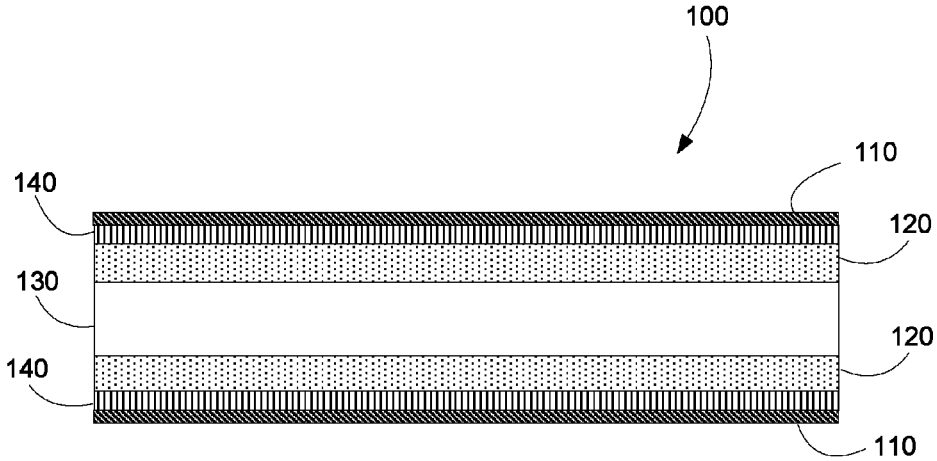
FIG. 4 is a cross-sectional view of a recording material, including coating layers that are applied to both sides of the supporting substrate, according to some other embodiments of the present disclosure.

In some examples, as illustrated in FIGS. 3 and 4, the recording material (100) contains a supporting substrate (130), a porous ink-absorbing layer (120) applied to at least one surface of said substrate (130), a glossy porous protective layer (140) applied over the porous ink-absorbing layer (120) and porous reflective top layer (110) applied over the glossy porous protective layer (140).

In some examples, such as illustrated in FIG. 3, the porous metallic reflective top layer (110), the glossy porous protective layer (140) and the porous ink-absorbing layer (120) are applied to only one side of the supporting substrate (130). If the coated side is used as an image-receiving side, the other side, i.e. backside, may not have any coating at all, or may be coated with other chemicals (e.g. sizing agents) or coatings to meet certain features such as to balance the curl of the final product or to improve sheet feeding in printer. In some other examples, such as illustrated in FIG. 4, the reflective top layer (110), the glossy porous protective layer (140) and the porous ink-absorbing layer (120) are applied to both opposing sides of the supporting substrate (130). The double-side coated medium has then a sandwich structure, i.e., both sides of the supporting substrate (130) are coated with the same coating and both sides may be printed with images or text.

The reflective top layer (110), the glossy porous layer (140) and the ink-absorbing layer (120) can be referred to as coating compositions or layers. Without being linked by any theory, it is believed that such coating layers are porous layers and are arranged and formulated in a way such that the ink droplets, sprayed on to the top of recording material during the image forming process, are rapidly absorbed in the coating layer without excessive lateral flow, so that sharp image edges free of bleeding and feathering can be obtained. The colorants from the inks need to be also rapidly fixed in order to provide images of adequate contrast, clean color tints and high optical density.

In some examples, the porous metallic reflective top layer (110) is optimized to be an optically reflective and/or an electrically conductive metal layer with enough porosity to allow penetration of liquid ink vehicle or metal etchant. As used herein, "metal etchant" refers to chemical species that are capable of "digesting" (i.e., etching off) the metal layer without significant damage to underlying absorbing layers. Choice of chemical reagent to be used in metal etchant formulations is dependent on the type of metal used for production of the porous metal layer.

In some examples, the porous metallic reflective top layer (110) has an average pore size that is less than 150 nm; in some other examples, the top layer (110) has an average pore size that is less than 60 nm. The thickness of the reflective top layer (110) can be in the range of about 5 nm to about 200 nm. In some examples, the thickness of the metallic reflective top layer (110) is in the range of about 7 to about 150 nm and, in some other examples, in the range of about 10 to about 100 nm.

Without being liked by any theory, it is believed that the average pore size of the top layer (110) is small enough to not affect negatively electrical conductivity while being large enough to allow rapid penetration of ink liquid phase into underlying porous layers. The latter facilitates proper print edge definition. The average pore size in said top layer (110) is also small enough to retain ink pigment particles on the surface, The porous metallic reflective top layer (110) may be formed from any metal with strong optical reflective properties and conductivity properties and/or from transition metals. In some embodiments, the reflective top layer (110) is formed with metal selected from the group consisting of aluminum (Al), titanium (Ti), silver (Ag), chromium (Cr), nickel (Ni), gold (Au), cobalt (Co), copper (Cu), platinum (Pt), palladium (Pd), rhodium (Rh) and alloys thereof. In some examples, the reflective top layer (110) is formed with Al.

In some examples, the porous metallic reflective top layer (110) is formed with aluminum and has an average pore size in the range of about 10 to about 150 nm. In some other examples, the reflective top layer (110) is formed with aluminum, has an average pore size in the range of about 5 to about 150 nm and has a thickness in the range of about 10 to about 150 nm. In yet some other examples, the porous metallic reflective top layer (110) is formed with aluminum, has an average pore size in the range of about 10 to about 80 nm and has a thickness in the range of about 15 to about 100 nm.

Without being linked by any theory, it is believed that the optimal thickness of the metallic reflective top layer depends on the type of metal used. For examples, metals that tend to form transparent metal oxide film on contact with air (such as Al, Cr, etc.) would require higher coating thickness than those that do not form surface oxide film (such as Ag, Au, Pt, etc.).

The porous ink-absorbing layer (120) is a middle porous inorganic layer. This porous ink-absorbing layer (120) has an absorption capacity (porosity) ranging from about 0.6 to about 1.2 liter/gram. The porous ink-absorbing layer (120) is a middle porous inorganic layer having the role of absorbing the ink vehicle phase that penetrate through the porous metallic reflective top layer (110) and through the glossy porous layer (140) when present. The porous ink-absorbing layer (120) has a coat-weight in the range of about 10 to 40 g/m$^2$ or in the range of about 15 to about 30 g/m$^2$ (or gsm). In some examples, the porous ink-absorbing layer (120) includes inorganic pigments in particulate form and at least one binder.

The porous ink-absorbing layer (120) can include inorganic pigment particles. Suitable inorganic pigments include metal oxides and/or semi-metal oxides particles. The inorganic semi-metal oxide or metal oxide particles may be independently selected from silica, alumina, boehmite, silicates (such as aluminum silicate, magnesium silicate and the like), titania, zirconia, calcium carbonate, clays, or combinations thereof. In some examples, the inorganic pigment is fumed alumina or fumed silica. In some other examples, the inorganic pigment particles are fumed silica (modified or unmodified). Thus, the inorganic pigment particles can include any number of inorganic oxide groups including, but not limited to silica and/or alumina, including those treated with silane coupling agents containing functional groups or other agents such as aluminum chloro-hydrate (ACH) and those having oxide/hydroxide. If silica is used, it can be selected from the following group of commercially available fumed silica: Cab-O-Sil® LM-150, Cab-O-Sil® M-5, Cab-O-Sil® MS-75D, Cab-O-Sil® H-5, Cab-O-Sil® HS-5, Cab-O-Sil® EH-5, Aerosil® 150, Aerosil® 200, Aerosil® 300, Aerosil® 350 and/or Aerosil® 400.

In some examples, the aggregate size of the fumed silica particles can be from approximately 50 to 300 nm in size. In some other examples, the fumed silica particles can be from approximately 100 to 250 nm in size. The Brunauer-Emmett-Teller (BET) surface area of the fumed silica particles can be from approximately 100 to 400 square meters per gram. In yet some other examples, the fumed silica can have a BET surface area from approximately 150 to 300 square meters per gram. The inorganic pigment particles can be alumina (modified or unmodified). In some examples, the alumina coating can comprise pseudo-boehmite, which is aluminum oxide/hydroxide ($Al_2O_3.n\,H_2O$ where n is from 1 to 1.5). Commercially available alumina particles can also be used, including, but not limited to, Sasol Disperal® HP10, Disperal® HP14, boehmite, Cabot Cab-O-Sperse® PG003 and/or CabotSpectrAl® 81 fumed alumina.

In some example, the porous ink-absorbing layer (120) contains fumed silica or fumed aluminas that are aggregates of primary particles. In some other example, the ink-absorbing layer contains fumed silica or fumed alumina that are aggregates of primary particles that have an average particle size ranging from about 120 nm to about 250 nm.

The amount of inorganic pigment particles may be from about 30 to 90% by weight (wt %) based on the total weight of the porous ink-absorbing layer. In some other examples, the amount of inorganic pigment may be from about 60 to 80% by weight (wt %) based on the total weight of the porous ink-absorbing layer.

A binder can be added to the porous ink-absorbing layer (120) to bind the particles together. In some examples, the ink-absorbing layer (120) includes inorganic pigment particles and at least one binder. The amount of binder that can be added provides a balance between binding strength and maintaining particulate surface voids and inter-particle spaces for allowing ink to be absorbed. The binders may be selected from polymeric binders; in some examples, the binders are water-soluble polymers and polymer latexes. Examples of binders include, but are not limited to, polyvinyl alcohols and water-soluble copolymers thereof, e.g., copolymers of polyvinyl alcohol and poly(ethylene oxide) or copolymers of polyvinyl alcohol and polyvinyl amine; cationic polyvinyl alcohols; aceto-acetylated polyvinyl alcohols; polyvinyl acetates; polyvinyl pyrrolidones including copolymers of polyvinyl pyrrolidone and polyvinyl acetate; gelatin; silyl-modified polyvinyl alcohol; styrene-butadiene copolymer; acrylic polymer latexes; ethylene-vinyl acetate copolymers; polyurethane resin; polyester resin; and combination thereof. Examples of binders include Poval® 235, Mowiol® 56-88, Mowiol® 40-88 (products of Kuraray and Clariant).

In some examples, the binder may be present in an amount representing of about 5 wt % to about 30 wt % by total weight of the porous ink-absorbing layer (120).

Without being linked by any theory, it is believed that the amount of binder in the porous ink-absorbing layer depends on the inorganic pigment used and is formulated to functionally bind the inorganic pigment particles so as to form a layer but still leaves spaces between the particles. In some examples, when polyvinyl alcohol is used as the binder and silica is the inorganic pigment, the amount of binder may be from about 20 wt % to about 25 wt %. In some other examples, when polyvinyl alcohol is used as the binder and alumina is the inorganic pigment, the amount of binder may be from 5 wt % to 10 wt %. The porous ink-absorbing layer (120) may further include optional additives such as mordants, biocides, optical brightener, surfactants, plasticizers and cross linking agents. Crosslinking agents for polyvinylalcohol might include boric acid, borax, glyoxal, glutaraldehyde, formaldehyde, etc. Moreover, the porous ink-absorbing layer may be a single layer or a multi-layer structure composed of different ink-absorbing layers that have been applied sequentially.

In some embodiments, the printable recording medium (100) can include a glossy porous layer (140). Said glossy porous layer (140) is a protective layer that could be applied over the porous ink-absorbing layer (120) and below the porous metallic reflective top layer (110).

In some examples, the porous layer (140) is a glossy porous layer, meaning thus that this layer (140) provide a gloss uniformity and a good image quality appearance of the print. Without being linked by any theory, it is believed that the porous layer (140) helps the print medium (100) to have good scratch resistance properties. Scratch resistance is also dependent on adhesion of the reflective top layer to the underlying substrate, i.e. glossy porous layer.

The glossy protective layer (140) can contain inorganic colloidal particles such as colloidal particles of metal oxides and semi-metal oxides or colloidal silica particles and water-soluble binders, such as polyvinylalcohol or copolymers of vinylpyrrolidone. In some examples, the glossy layer (140) is highly porous and contains metal or semi-metal oxide particles (or combination of both). The glossy layer (140) has high volume porosity and high liquid absorbing capacity. The liquid components of ink, deposed onto the printable medium, are drained into it, through the pores of the metallic reflective top layer (110). Without being linked by any theory, it is believed that the capillary pressure is high enough to drain the fluid very fast vertically. It prevents significant lateral ink drop spread on the media surface and results in very good print quality and excellent print edge definition.

The particle size, as measured by diameter, of the inorganic colloidal particles, present in the middle porous layer (140), can be from about 5 nm to about 150 nm. In some examples, the particle size is from about 20 nm to about 100 nm. In some other examples, the particle size is from about 30 nm to about 80 nm. The particle size can be measured by photon correlation spectroscopy or scanning electron microscopy. In some examples, the glossy layer (140) is a porous layer with pore diameters in the range of about 3 to about 100 nm, in some other examples, in the range of about 5 to 50 about nm.

Inorganic colloidal particles refer herein to dispersed particles in water or in water-miscible organic solvents. Inorganic colloidal particles can be selected from the group consisting of silica, clay, kaolin, calcium carbonate, talc, titanium dioxide and zeolites. In some examples, inorganic colloidal particles present in the middle porous layer (140) can be inorganic oxide colloidal particles such as colloidal silica, aluminum oxides (boehmites) and mixture of them. In some examples, the inorganic colloidal particles are colloidal silica particles. As such, the colloidal silica can be a stable dispersion of amorphous silica particles. The colloidal silica can include discrete silica particles suspended in water or the colloidal silica can have a spherical particle shape dispersed in water. However, it is to be understood that the colloidal silica is not necessarily perfectly spherical, but can have a general spherical shape that is rounded. Examples of colloidal inorganic particles used in the glossy layer (140) includes, but is in no way limited to, Cartacoat® K (available from Clariant Chemical); Snowtex® ST-O, ST-OL, ST-20L and ST-C (available from Nissan Chemical); Ludox® CL, AM and TMA (available from Grace-Davison Chemical); Nyacol® AL20, Nyacol® AL20, Nyacol® A1530, Nyacol® Ce02, Nyacol® SN15, Nyacol® DP5370 and NYACOL® Zr50/20 (available from Nyacol Nano Technologies). Two or more colloidal silica particles can be used together. Additionally, the middle porous layer (140) can include other inorganic particulates such as other metal oxides and/or semi-metal oxides. In some examples, colloidal inorganic particles are spherical colloidal silica and/or alumina. Examples of colloidal silica include Ludox®, Ludox® CL, Nexsil® 85A, Nexsil® 85, Clariant® K303C and Clariant® K303. Examples of colloidal alumina include Disperal® and Dispal® HP-14 available from Sasol technologies Inc.

In some examples, the glossy porous layer (140) contains spherical colloidal silica particles with particle size ranging from about 30 to about 80 nm. In some other examples, the porous layer 140 contains colloidal silica or alumina that are discrete, individual particles with particle size less than 100 nm. In yet some other examples, such colloidal silica or alumina particles are mainly spherical in shape have an average size ranging from about 20 to about 80 nm. The porosity of the glossy porous layer can be less than about 0.2 liter/gram.

The middle porous layer (140) can contain binders. Such binders can be polyvinylalcohol or copolymer of vinylpyrrolidone. The copolymer of vinylpyrrolidone can include various other copolymerized monomers, such as methyl acrylates, methyl methacrylate, ethyl acrylate, hydroxyethyl acrylate, hydroxyethyl methacrylate, ethylene, vinylacetates, vinylimidazole, vinylpyridine, vinylcaprolactams, methyl vinylether, maleic anhydride, vinylamides, vinylchloride, vinylidene chloride, dimethylaminoethyl methacrylate, acrylamide, methacrylamide, acrylonitrile, styrene, acrylic acid, sodium vinylsulfonate, vinylpropionate and methyl vinylketone, etc. In some examples, the copolymer of vinylpyrrolidone can be a copolymer of vinylpyrrolidone and vinylacetate or vinylcaprolactam or polyvinylalcohol. The polyvinylalcohol or copolymer of vinylpyrrolidone can have a weight average molecular weight ranging from about 10,000 Mw to about 1,000,000 Mw or can have a weight average molecular weight ranging from about 20,000 Mw to about 500,000 Mw. In some examples, the binder is a polyvinylalcohol having a molecular weight in the range of about 20,000 to about 500,000.

The middle porous layer (140) can contain colloidal silica particles and greater than about 5 wt % of polyvinylalcohol. In some examples, binders can be present in the middle porous layer (140) at from about 0 wt % to about 15 wt % by weight based on the total dry weight of inorganic colloidal particles. In some examples, the weight percentage of binder, based on the total dry weight of inorganic colloidal particles, is ranging from about 5 to about 12%. The viscosity of the middle porous layer (140) can be varied depending on the desired application or manufacturing process. In some examples, the viscosity can be at least 25 cps. In some other examples, the viscosity can be at least 35 cps. The coat weight of the gloss layer (140) can be about 0.05 $g/m^2$ to about 5 $g/m^2$. In some examples, the coat weight of the gloss layer (140) can be from about 0.1 $g/m^2$ to about 2 $g/m^2$ and, in some other examples, from about 0.25 $g/m^2$ to about 1.0 $g/m^2$.

To improve the coating quality and curtain stability, a thickener can be used to increase the viscosity of the layer. Suitable thickeners include polyethyleneoxide, polyvinylpyrrolidone, gelatin, hydroxylethylcellulose, hydroxymethylcellulose, polyacrylamide, including copolymers thereof and mixtures thereof. In some examples, the thickener is polyethyleneoxide. Commercially available polyethyleneoxides include Alkox E-45, E-75, E-240, E-300C and Polyox WSR N-12K, WSR N-60K, WSR-301, WSR-303.

The printable medium (100) contains a supporting substrate (130) that acts as a bottom substrate layer. The porous metallic reflective top layer (110), the glossy porous layer (140) and the porous ink-absorbing layer (120) form a coating layer on said supporting substrate (130) and, in other word, create a recording material that is well adapted for inkjet printing device. The supporting substrate (130) which supports the porous metallic reflective top layer (110), the glossy porous layer (140) and the porous ink-absorbing layer (120), may take the form of a sheet, a web, or a three-dimensional object of various shapes. The supporting substrate can be any material that will be able to provide a mechanical support to the above mentioned layers. In some examples, the supporting substrate can be a flexible film or a rigid paper substrate. As non-limiting examples, the supporting substrate (130) may be selected from cellulosic or synthetic paper (coated or uncoated), cardboard, polymeric film (e.g. plastic sheet like PET, polycarbonate, polyethylene, polypropylene), fabric, cloth and other textiles. In some other examples, the bottom substrate layer may be single material plastic film made from PET, polyimide or other suitable polymer film with adequate mechanical properties. In some examples, the supporting substrate can be metal foils, rigid and/or flexible glasses. The supporting substrate (130) can be of any type and size. In some examples, the supporting substrate (130) includes any substrate that is suitable for use in digital color imaging devices, such as electrophotographic and/or inkjet imaging devices, including, but in no way limiting to, resin coated papers (so-called photobase papers), papers, overhead projector plastics, coated papers, fabrics, art papers (e.g. water color paper), plastic film of any kind and the like. The substrate includes porous and non-porous surfaces.

In some other examples, the supporting substrate (130) is paper (non-limitative examples include plain copy paper or papers having recycled fibers therein) or photopaper (non-limitative examples include polyethylene or polypropylene extruded on one or both sides of paper) and/or combinations thereof. A photobase may be used as the supporting substrate (130). Photobase is a coated photographic paper, which includes a paper base extruded one or both sides with polymers, such as polyethylene and polypropylene typical coat weight of the extruded polymer layers is from 5 to 45 gsm. Photobase support can include a photobase material including a highly sized paper extruded with a layer of polyethylene on both sides. In this regard, the photobase support is an opaque water-resistant material exhibiting qualities of silver halide paper. In some examples, the photobase support includes a polyethylene layer having a thickness of about 10 to 24 grams per square meter (gsm). The photobase support can also be made of transparent or opaque photographic material. In particular, the photobase support can include, but is not limited to, clear films. The clear films can be made of materials such as, but not limited to, cellulose esters, including cellulose triacetate, cellulose acetate, cellulose propionate, or cellulose acetate butyrate, polyesters, including poly (ethylene terephthalate), polyimides, polycarbonates, polyamides, polyolefins, poly(vinyl acetals), polyethers, polyvinyl chloride and polysulfonamides. The opaque photographic materials can include, but is not limited to, baryta paper, polyethylene-coated papers and voided polyester. In some examples, the photobase support can be made of non-photographic materials (e.g., transparent films). In particular, the non-photographic materials can include, but are not limited to, polyesters, diacetates, triacetates, polystyrenes, polyethylenes, polycarbonates, polymethacrylates, cellophane, celluloid, polyvinyl chlorides, polyvinylidene chlorides, polysulfones and polyimides. In some others examples, the photobase support can be made of plain paper of various different types, including, but not limited to, pigmented papers and cast-coated papers, as well as metal foils, such as foils made from aluminum.

In some examples, the porous metallic reflective top layer (110), the glossy porous layer (140) and the porous ink-absorbing layer (120) are disposed on the supporting substrate (130) and form a multilayered coating layer having a coat weight that is in the range of about 10 to about 75 gram per square meter ($g/m^2$) per side. In some examples, the supporting substrate (130) has a thickness along substantially the entire length ranging between about 0.025 mm and about 0.5 mm.

A method of forming a multilayered metalized printable recording media (100), such as defined above, includes applying a porous ink-absorbing layer (120) onto a supporting substrate (130), then, eventually, applying a glossy porous protective layer (140) and finally depositing the porous metallic reflective top layer (110). The porous ink-absorbing layer (120) can be coated onto the supporting substrate via any coating techniques to form the porous ink-absorbing layer (120), followed by drying techniques. Methods of application may include, but are not limited to, curtain coating, cascade coating, fountain coating, slide coating, slot coating, blade coating, rod coating, air-knife coating, size-press (including puddle and metered size press), or hopper coating. The glossy porous protective layer (140) can then be applied onto the porous ink-absorbing layer (120) using the same technique.

In some examples, the porous metallic reflective top layer (110) is formed on the top of the porous ink-absorbing layer (120) or on the top of the glossy porous protective layer (140) by vacuum thin film deposition technique and it is formed so as to have enough porosity to allow the penetration of the liquid component (i.e., liquid carrier) of the ink. In some other examples, the porous metallic reflective top layer (110) is formed on the top of the porous ink-absorbing layer (120), or on the top of the glossy porous protective layer (140), by electron beam evaporation and at a low substrate deposition temperature.

The porous metallic reflective top layer (110) can thus be formed using an electron beam evaporation technique or a sputter deposition at a low substrate deposition temperature (i.e. below 150° C.). In some examples, when using electron beam evaporation, the deposition chamber is evacuated to a pressure of about $3 \cdot 10^{-6}$ Torr. The electron beam power can be ramped up at a rate of about 40 W/sec until a steady state deposition rate of about 0.1 nm/sec is achieved, at which point the deposition shutters are opened exposing the layer upon which metal vapor condenses creating the porous metallic reflective top layer (110). In some other examples, the reflective top layer (110) is formed by sputter deposition at a low substrate deposition temperature (i.e. below 150° C.). When using sputter deposition technique, the process chamber is firstly evacuated to a pressure of about $5 \cdot 10^{-}7$ Torr. Inert gas is flowed into the sputter chamber to maintain a deposition pressure of about $6 \cdot 10^{-}3$ Torr and DC magnetron sputtering, at a process power of 500 W, is employed to generate said porous metallic reflective top layer (110).

Without being linked by any theory, it is belied that the low substrate deposition temperature reduces the possibility of thermal damage to the media and reduces the possibility of surface diffusion when the metal atoms condense on the medium.

The obtained printable recording medium is thus a metalized recording medium that has both reflectivity and conductivity of a thin metal foil while having ink absorbing porosity of high-end inkjet media.

In some examples, a method of forming printed images on metalized printable recording medium including a porous metallic reflective top layer (110), a porous ink-absorbing layer (120) and a bottom supporting substrate (130) encompasses projecting a stream of droplets of ink composition, via inkjet printing technique, onto said medium to form the desired printed image. In some examples, the method of forming printed images on medium such as defined herein uses an inkjet ink composition. In some examples, the method of forming printed images is done in a heated environment. The ink composition may be established on the metalized printable recording medium via any suitable inkjet printing technique. Non-limitative examples of such inkjet printing technique include thermal, acoustic, continuous and piezoelectric inkjet printing. By inkjet composition, it is meant herein that the composition is very well adapted to be used in an inkjet device and/or in an inkjet printing process.

In some examples, the ink composition referred herein comprises one or more colorants that impart the desired color to the printed message. As used herein, "colorant" includes dyes, pigments and/or other particulates that may be suspended or dissolved in an ink vehicle. In some other examples, the inks comprise pigments as colorants. Pigments that can be used include self-dispersed pigments and non self-dispersed pigments. Suitable pigments can be black pigments, white pigments, cyan pigments, magenta pigments, yellow pigments, or the like. Pigments can be organic or inorganic particles as well known in the art. As used herein, "liquid vehicle" or "ink vehicle" is defined to include any liquid composition that is used to carry colorants, including pigments, to a substrate. Liquid vehicles are well known in the art and a wide variety of liquid vehicle components may be used. Such liquid vehicles may include a mixture of a variety of different agents, including without limitation, surfactants, solvents and co-solvents, buffers, biocides, viscosity modifiers, sequestering agents, stabilizing agents and water. Though not liquid per se, the liquid vehicle can also carry other solids, such as polymers, UV curable materials, plasticizers, salts, etc.

In some examples, a printing method encompass obtaining a metalized printable recording medium (100) including a porous metallic reflective top layer (110), eventually a glossy porous layer (140), a porous ink-absorbing layer (120) and a photobase as a bottom supporting substrate (130) then, inkjetting a pigmented ink onto said recording material, to form a printed image; and drying the printed image in view of providing a printed medium with enhanced image quality and enhanced absorption performances. In some examples, said method will result in prints with strong "metallic" appearance and high print quality/sharp details resolution typical when printing.

In some examples, the metalized printable recording medium such as defined above can be used to produce "printed electronics medium". As "printed electronic medium", it is meant herein recording medium that is able to conduct electricity and/or that can have high electrical conductivity.

The metalized medium as defined herein may be patterned using inkjet printing in a subtractive processing mode. In some examples, a method of forming printed images on metalized printable recording medium, including a porous metallic reflective top layer (110), a porous ink-absorbing layer (120) and a bottom supporting substrate (130), encompasses projecting a stream of droplets of etching ink composition, via inkjet printing technique, onto said medium to form the desired printed image. In some examples, the etching ink composition contains an etching agent (such as tetra-methyl-ammonium hydroxide for examples), solvent and/or co-solvents, surfactants. The nature of the etching agent is dependent with the type of metal used for top metal reflective layer.

The preceding description has been presented only to illustrate and describe some embodiments of the present invention. However, it is to be understood that the following are only illustrative of the application of the principles of the present print medium and methods.

EXAMPLE 1

A metalized printable recording medium is produced with a single pass (wet-on-wet) coating method using a curtain coater.

A porous ink-absorbing layer and, in some examples, a glossy layer are applied onto a photobase ("HP Advanced photo-paper" as supporting substrate) (166 or 171 g/m$^2$ raw base paper). The ink-absorbing layer is applied first to the front side of the photopaper with a roller coater. When present, the glossy layer is coated on the top of the ink-absorbing bottom layer. The coat weight of the ink-absorbing layer is from 10 to 40 gsm and the coat weight of the glossy layer is from 0.1 to 2 gsm. The metallic reflective top layer is deposited on the recording medium using a Venzon Engineering CPA sputter deposition system. The layered substrate is thus transported on a conveyer through the deposition system process parameters such as conveyer velocity, power, pressure, ionizing gas (sputtering) and substrate temperature. Deposit thickness and properties are controlled by conveyer velocity. The medium is coated with an Aluminum reflective top layer having 30, 40, 50 or 100 nm thicknesses.

The formulations of the different coating layers are expressed in the Table (a) below. Unless otherwise specified, each number represent the part per weight of each components present in each layer.

TABLE (a)

| Layers | Ingredients | Formula A | Formula B | Formula C | Formula D |
|---|---|---|---|---|---|
| Reflective top layer (110) | Aluminum | 100 | 100 | 100 | 100 |
| | Coating Thickness | 40 nm | 50 nm | 30 nm | 100 nm |
| Glossy protective layer (140) | Disperal ® HP-14 | 75 | 75 | 75 | — |
| | Cartacoat ® K303C | 25 | 25 | 25 | — |
| | PVA 2 | 11 | 11 | 11 | — |
| | Coat-weight | 0.5 gsm | 0.5 gsm | 0.5 gsm | — |
| ink-absorbing layer (120) | Treated Silica 1 | 100 | — | — | 100 |
| | Treated Silica 2 | — | 100 | 100 | — |
| | PVA 1 | 21 | — | — | 21 |
| | PVA 2 | — | 18 | — | — |
| | Boric Acid | 2.5 | 2.25 | 2.5 | 2.5 |
| | Silwet ® L-7600 | 0.5 | 0.75 | 0.5 | 0.5 |
| | Glycerol | 1.5 | 1.5 | 1.5 | 1.5 |
| | Zonyl ® FSN | 0.1 | 0 | 0.1 | 0.1 |
| | Coat-weight | 28 gsm | 22 gsm | 28 gsm | 28 gsm |

Treated silica 1 is Cab-O-Sil MS-55 (available from Cabot) treated with ACH and Silquest A-1110. Treated silica 2 is based on Cab-O-Sil LM-150 (available from Cabot) treated with ACH and Onichem A-301. PVA 1 is Poval 235 from Kuraray. PVA 2 is Mowiol 40-88 from Kuraray. Zonyl® FSN is a fluorosurfactants available from DuPont Inc. Cartacoat® K303C is Cationic colloidal silica available from Clariant. Disperal® HP-14 is boehmite available from Sasol technologies Inc. Silwet® L-7600 is a surfactant from GE silicone Inc.

EXAMPLE 2

The reflectivity and the bulk resistivity of the metalized printable recording medium of formulation A, obtained in example 1, is measured as a function of the porous metallic reflective top layer thickness. The metalized printable recording medium is coated with an Aluminum reflective top layer having 7.5, 10, 15, 20, 30, 40 and 50 nm thicknesses.

The Reflectivity of the metalized printable recording medium is measured using N&K Analyzer 1280 spectral photometer. This apparatus reports the reflectivity over 190-900 nm wavelength range and works by measuring the intensity of the reflected light and comparing that intensity to a reference beam. The reflectivity data collected herein is reported at a reflectivity at a single wavelength 633 nm (the specular reflection is measured at 90 deg).

Figure 5A:
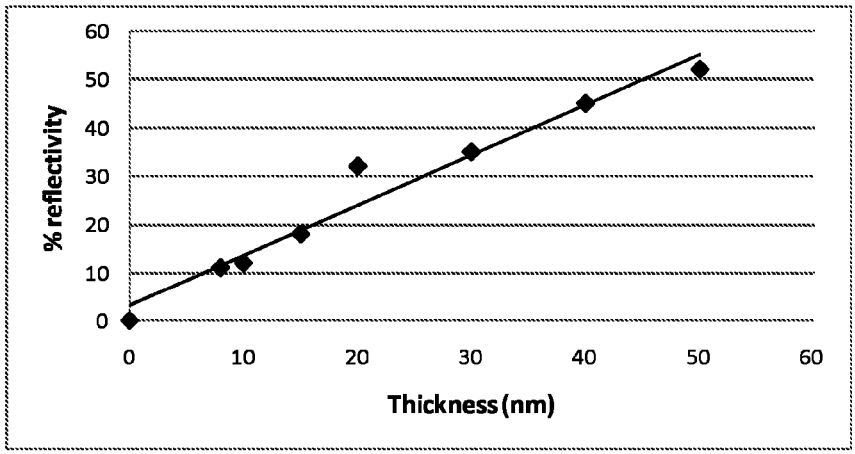
FIG. 5A is a graph illustrating the percentage of reflectivity in function of the thickness of the reflective top layer of the printable recording medium according to embodiments of the present disclosure.

FIG. 5A illustrates the reflectivity of the medium obtained in function of the thickness of the porous metallic reflective top layer. The reflectivity increases linearly to approximately 50% (measured at 633 nm) for a 50 nm thick Aluminum photopaper. The obtained media has a metallic appearance, is perceived as optically smooth and is capable of strong metallic specular reflection.

The bulk resistivity is calculated using the sheet resistance (the sheet resistance exemplifies films that conduct electricity; the sheet resistance is a measure of resistance of films that are uniform in thickness). The sheet resistance is measured using a 4 Dimensions model 280 4 point probe meter. The sheet resistance is multiplied by the thickness of the film to arrive the bulk resistivity of the conductive layer. The bulk resistivity represents then the intrinsic resistivity that is an attribute of the material measured. The bulk resistivity is usually independent of thickness.

Figure 5B:
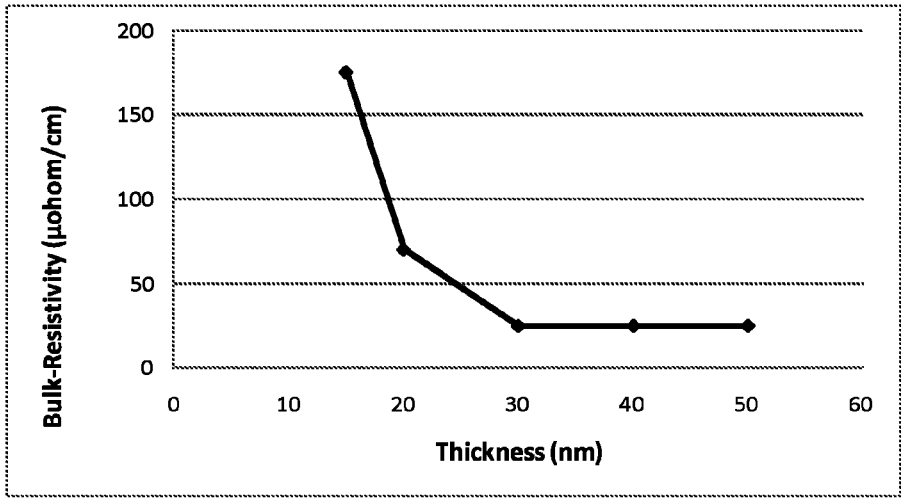
FIG. 5B is a graph illustrating the bulk-resistivity in function of the thickness of the reflective top layer of the printable recording medium according to embodiments of the present disclosure.

FIG. 5B illustrates the bulk resistance of the printable recording medium obtained in function of the thickness of the aluminum reflective top layer. The data show that, with aluminum reflective top layer, a constant bulk resistivity (i.e. a resistivity that does not vary with thickness) is obtained with layer thickness of approximately 30 nm (i.e. the bulk resistivity of Al layers greater than 30 nm thick is constant at 20 μohm·cm).

The invention claimed is:

1. A metalized printable recording medium comprising:

a. a porous metallic reflective top layer, b. a porous ink-absorbing layer, c. and a bottom supporting substrate.

2. The metalized printable recording medium according to claim 1 wherein the porous metallic reflective top layer is formed with metals selected from the group consisting of aluminum (Al), titanium (Ti), silver (Ag), chromium (Cr), nickel (Ni), gold (Au), cobalt (Co), copper (Cu), platinum (Pt), palladium (Pd), rhodium (Rh) and alloys thereof.

3. The metalized printable recording medium according to claim 1 wherein the porous metallic reflective top layer is formed with aluminum (Al).

4. The metalized printable recording medium according to claim 1 wherein the thickness of the porous metallic reflective top layer is in the range of about 5 nm to about 200 nm.

5. The metalized printable recording medium according to claim 1 wherein the porous metallic reflective top layer has an average pore size in the range of about 5 nm to about 150 nm.

6. The metalized printable recording medium according to claim 1 wherein the porous metallic reflective top layer is formed with aluminum, has an average pore size in the range of about 5 nm to about 150 nm and has a thickness in the range of about 10 nm to about 150 nm.

7. The metalized printable recording medium according to claim 1 wherein the porous ink-absorbing layer includes inorganic pigment particles and at least one binder.

8. The metalized printable recording medium according to claim 1 wherein the porous ink-absorbing layer contains fumed silica or fumed alumina that have an average particle size ranging from about 120 nm to about 250 nm.

9. The metalized printable recording medium according to claim 1 wherein the porous ink-absorbing layer has a coat-weight in the range of about 10 to about 40 $g/m^2$.

10. The metalized printable recording medium according to claim 1 wherein the bottom supporting substrate is a photobase.

11. A metalized printable recording medium, comprising:

a porous metallic reflective top layer;

a porous ink-absorbing layer;

a bottom supporting substrate; and a glossy porous layer under the porous metallic reflective top layer.

12. A method of forming a metalized printable recording medium such as defined in claim 1 comprising applying a porous ink-absorbing layer on a supporting substrate and depositing a porous metallic reflective top layer by vacuum thin film deposition technique.

13. The metalized printable recording medium according to claim 11 wherein the glossy porous layer contains inorganic colloidal particles that have an average particle size ranging from about 5 nm to about 150 nm.

14. A method of forming printed images comprising:

a. obtaining a metalized printable recording media including a porous metallic reflective top layer, a porous ink-absorbing layer and a bottom supporting substrate;

b. then projecting a stream of droplets of ink composition, via inkjet printing technique, onto said media to form the desired printed image.

15. The method of forming printed images such as defined in claim 14 wherein the ink composition is an inkjet ink composition including pigments as colorants.

* * * * *